US010698337B2

(12) United States Patent
Shimizu et al.

(10) Patent No.: US 10,698,337 B2
(45) Date of Patent: Jun. 30, 2020

(54) IMAGE FORMING APPARATUS WITH DEVELOPER INFORMATION ACQUISITION UNIT THAT ACQUIRES INFORMATION RELATING TO DETERIORATION OF DEVELOPER BASED ON AN ACQUIRED TONER CHARGING AMOUNT

(71) Applicant: KYOCERA Document Solutions Inc., Osaka-shi (JP)

(72) Inventors: Tamotsu Shimizu, Osaka (JP); Akifumi Yamaguchi, Osaka (JP); Yasuhiro Tauchi, Osaka (JP); Eiji Gyotoku, Osaka (JP); Yu Sasaki, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/424,674

(22) Filed: May 29, 2019

(65) Prior Publication Data

US 2019/0369523 A1 Dec. 5, 2019

(30) Foreign Application Priority Data

May 30, 2018 (JP) ..... 2018-103215

(51) Int. Cl.
*G03G 15/06* (2006.01)
*G03G 15/08* (2006.01)
*G03G 15/00* (2006.01)

(52) U.S. Cl.
CPC ..... *G03G 15/065* (2013.01); *G03G 15/0806* (2013.01); *G03G 15/0848* (2013.01);
(Continued)

(58) Field of Classification Search
CPC ..... G03G 15/065; G03G 15/0806; G03G 15/0848; G03G 15/5041;
(Continued)

(56) References Cited

U.S. PATENT DOCUMENTS 5,729,787 A * 3/1998 Resch, III ..... G03G 15/0851 324/204
2003/0219266 A1 11/2003 Itagaki et al.
(Continued)

FOREIGN PATENT DOCUMENTS

JP 2003-345075 12/2003
JP 2004-37952 2/2004
(Continued)

*Primary Examiner* — Walter L Lindsay, Jr.
*Assistant Examiner* — Laura Roth
(74) *Attorney, Agent, or Firm* — Gerald E. Hespos; Michael J. Porco; Matthew T. Hespos

(57) ABSTRACT

An image forming apparatus includes a developer information acquisition unit. The developer information acquisition unit performs a developer deterioration information acquisition operation. In the developer deterioration information acquisition operation, the developer information acquisition unit acquires a tilt of a measurement straight line representing the relationship between the change amount of the frequency in a first measurement toner image forming operation and the density change amount of the measurement toner image based on the change amount of the frequency in the first measurement toner image forming operation and a result of detecting density of the measurement toner image in a density detecting unit, and acquires a toner charging amount based on the acquired tilt of the measurement straight line and the reference information in the storage unit so as to acquire information relating to deterioration of developer based on the acquired toner charging amount.

8 Claims, 12 Drawing Sheets

(52) U.S. Cl.
CPC ..... *G03G 15/5041* (2013.01); *G03G 15/5058* (2013.01); *G03G 2215/00037* (2013.01); *G03G 2215/00059* (2013.01)

(58) Field of Classification Search
CPC ..... G03G 2215/00029; G03G 2215/00033; G03G 2215/00037; G03G 2215/00059; G03G 15/5054; G03G 15/5058
See application file for complete search history.

(56) References Cited

U.S. PATENT DOCUMENTS

| | | | | |
|---|---|---|---|---|
| 2006/0198655 | A1* | 9/2006 | Kotera ..... | G03G 15/0921 399/104 |
| 2009/0297229 | A1* | 12/2009 | Tomizawa ..... | G03G 15/09 399/274 |
| 2012/0327480 | A1 | 12/2012 | Yamane | |
| 2013/0028621 | A1* | 1/2013 | Furukawa ..... | G03G 15/06 399/55 |
| 2017/0153564 | A1 | 6/2017 | Kanaya | |
| 2019/0369521 | A1 | 12/2019 | Shimizu | |
| 2019/0369537 | A1 | 12/2019 | Yamaguchi | |
| 2020/0103785 | A1* | 4/2020 | Shimizu ..... | G03G 15/065 |

FOREIGN PATENT DOCUMENTS

| | | |
|---|---|---|
| JP | 4480066 | 3/2010 |
| JP | 5024192 | 6/2012 |
| JP | 5273542 | 5/2013 |

* cited by examiner

IMAGE FORMING APPARATUS WITH DEVELOPER INFORMATION ACQUISITION UNIT THAT ACQUIRES INFORMATION RELATING TO DETERIORATION OF DEVELOPER BASED ON AN ACQUIRED TONER CHARGING AMOUNT

INCORPORATION BY REFERENCE

This application contains subject matter related to Japanese Patent Application No. 2018-103215 filed in Japanese Patent Office on May 30, 2018, the entire content of which being incorporated herein by reference.

BACKGROUND

The present disclosure relates to an image forming apparatus that forms an image on a sheet.

Conventionally, a known image forming apparatus, which forms an image on a sheet, includes a photoconductive drum (an image carrier), a developing device, and a transfer member. An electrostatic latent image formed on the photoconductive drum is developed on a development nip portion by the developing device, and thus a toner image is formed on the photoconductive drum. The transfer member transfers the toner image to a sheet. As the developing device to be applied to such an image forming apparatus, a two-component developing technique using developer including toner and carrier is known.

In the two-component development, the developer is deteriorated due to influences of a number of sheets to be printed, a change in environment, a printing mode (a number of sheets to be sequentially printed per one job), and a page-coverage rate, and thus a toner charging amount changes. Such a phenomenon causes problems such as a decrease in image density, occurrence of tonner fogging, and an increase in toner flying. A conventional technique, which solves such a problem, predicts a change in a charging amount of developer based on a number of sheets to be printed, a change in environment, a printing mode, and a page-coverage rate, and adjusts toner density, a development bias, a surface potential of a photoconductor, a rotational speed of a developing roller, and an output of a suction fan that collects flying toner, thus suppressing a decrease in image density, deterioration of toner fogging, and deterioration of toner flying.

However, such a technique is only a combination of individual predictions under conditions of a number of sheets to be printed, a change in environment, a printing mode, and a page-coverage rate, and thus if a plurality of conditions are changed compositively, it is difficult to sufficiently predict a charging amount of developer.

Therefore, a technique for accurately predicting a charging amount of toner is proposed. In this technique, a surface potential of a photoconductive drum before development and a surface potential of a toner layer on the photoconductive drum after development are individually measured, whereas a toner developing amount is calculated based on an image density measured result on the developed toner layer. The toner charging amount is calculated based on the measured surface potentials and toner developing amount.

In this technique, a value of an electric current flowing into the developing roller that carries developer is measured, and the measured current value is predicted as an amount of toner charges which transfer from the developing roller to the photoconductive drum. A toner developing amount is calculated based on the image density measured result on the developed toner layer. Further, a toner charging amount is calculated based on the amount of toner charges and the toner charging amount.

SUMMARY

According to one aspect of the present disclosure, an image forming apparatus performs an image forming operation for forming an image on a sheet. The image forming apparatus includes an image carrier, a charging device, an exposing device, a developing device, a transfer unit, a development bias applying unit, a density detecting unit, a storage unit, and a developer information acquisition unit. The image carrier is rotated and carries a toner image obtained by developing an electrostatic latent image which is formed on a surface of the image carrier. The charging device charges the image carrier to a predetermine charging potential. The exposing device exposes the surface of the image carrier charged to the charging potential, based on predetermined image information so as to form the electrostatic latent image, the exposing device being disposed in a rotational direction of the image carrier downstream with respect to the charging device. The developing device is disposed in a predetermined development nip portion in the rotational direction downstream with respect to the exposing device so as to oppose the image carrier. The developing device includes a developing roller that is rotated, carries developer including toner and carrier on a peripheral surface of the developing roller, and supplies the toner to the image carrier so as to form the toner image. The transfer unit transfers the toner image carried on the image carrier to a sheet. The development bias applying unit applies a development bias obtained by superimposing an alternating current voltage on a direct current voltage to the developing roller. The density detecting unit detects density of the toner image. The storage unit stores reference information in advance for each toner charging amount, the reference information relating to a tilt of a reference straight line representing a relationship between a change amount of a frequency of the alternating current voltage of the development bias and a density change amount of the toner image in a case where the frequency is changed with a potential difference in the direct current voltage between the developing roller and the image carrier being kept constant. The developer information acquisition unit performs a first measurement toner image forming operation and a developer deterioration information acquisition operation. The developer information acquisition unit performs the first measurement toner image forming operation for controlling the development bias applying unit at a plurality of timings among which at least the image forming operation is performed so that a potential difference in a direct current voltage between the developing roller and the image carrier is kept constant and a frequency of an alternating current voltage of the development bias is varied among the plurality of timings, and forming a measurement toner image on the image carrier at the plurality of timings. In the developer deterioration information acquisition operation, the developer information acquisition unit acquires a tilt of a measurement straight line representing a relationship between a change amount of the frequency in the first measurement toner image forming operation and a density change amount of the measurement toner image based on the change amount of the frequency in the first measurement toner image forming operation and a result of detecting density of the measurement toner image in the density detecting unit, and acquires the toner charging amount based on the acquired tilt of the measurement straight line and reference information in the storage unit so as to acquire information relating to deterioration of the developer based on the acquired toner charging amount.

DETAILED DESCRIPTION

An image forming apparatus 10 according to an embodiment of the present disclosure will be described in detail below with reference to the drawings. The present embodiment illustrates a tandem color printer as one example of the image forming apparatus. Examples of the image forming apparatus may be a copying machine, a facsimile device, and a complex machine of them. The image forming apparatus may form a single-color (monochrome) image.

Figure 1:
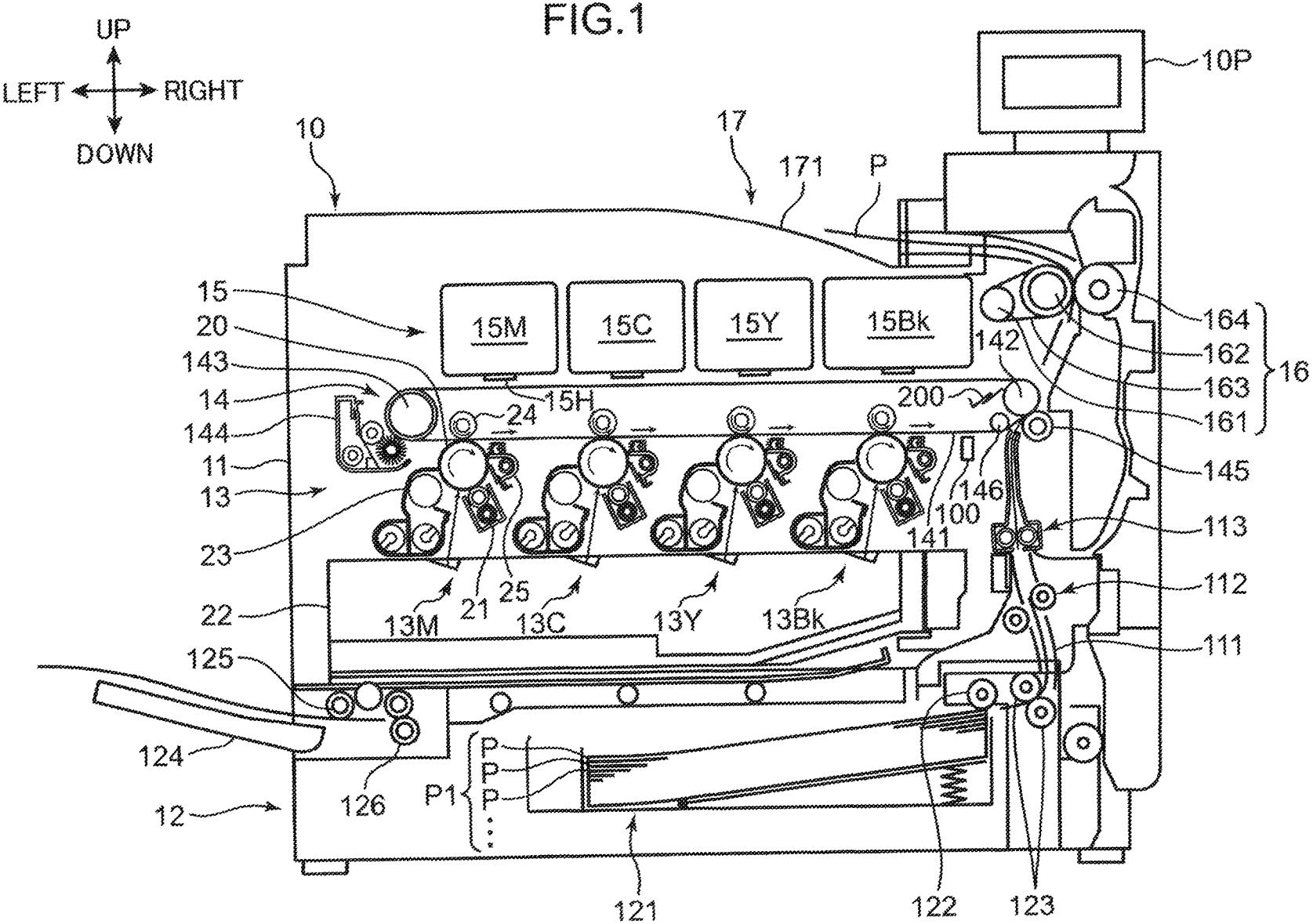
FIG. 1 is a cross-sectional view illustrating an internal structure of an image forming apparatus according to an embodiment of the present disclosure.

FIG. 1 is a cross-sectional view illustrating an internal structure of the image forming apparatus 10. The image forming apparatus 10 includes an apparatus main body 11 having a box-shaped housing structure. The apparatus main body 11 includes a sheet feeding unit 12 that feeds a sheet P an image forming unit 13 that forms a toner image to be transferred to the sheet P fed from the sheet feeding unit 12, an intermediate transfer unit 14 (a transfer unit) that primarily transfers the toner image, a toner supply unit 15 (a toner housing unit) that houses toner to be supplied to the image forming unit 13, and a fixing unit 16 that executes a fixing process for fixing an unfixed toner image formed on the sheet P to the sheet P. A sheet ejection portion 17, onto which the sheet P which has been subject to the fixing process in the fixing unit 16 is ejected, is disposed on an upper portion of the apparatus main body 11.

An operation panel, not illustrated, for inputting output conditions or the like for the sheet P is disposed on an appropriate position on an upper surface of the apparatus main body 11. The operation panel includes a power key, and a touch panel and various operation keys that are used for inputting the output conditions.

The apparatus main body 11 includes a sheet conveyance path 111 that extends vertically on a right position with respect to the image forming unit 13. A conveyance roller pair 112 that conveys a sheet to an appropriate position is disposed on the sheet conveyance path 111. A registration roller pair 113 is disposed on an upstream side of a nip portion on the sheet conveyance path 111. The registration roller pair 113 adjusts skew of a sheet and sends the sheet to the nip portion for secondary transfer, described later, at predetermined timing. The sheet conveyance path 111 is a conveyance path through which the sheet P is conveyed from the sheet feeding unit 12 to the sheet ejection portion 17 via the image forming unit 13 and the fixing unit 16.

The sheet feeding unit 12 includes a sheet feeding tray 121, a pickup roller 122, and a sheet feeding roller pair 123. The sheet feeding tray 121 is detachably attached to a lower portion of the apparatus main body 11, and a sheet bundle P1 including a plurality of laminated sheets P is stored on the sheet feeding tray 121. The pickup roller 122 feeds a top sheet P of the sheet bundle P1 stored on the sheet feeding tray 121 one by one. The sheet feeding roller pair 123 sends the sheet P fed by the pickup roller 122 to the sheet conveyance path 111.

The sheet feeding unit 12 includes a manual sheet feeding unit which is mounted to a left side surface, illustrated in FIG. 1, of the apparatus main body 11. The manual sheet feeding unit includes a bypass tray 124, a pickup roller 125, and a sheet feeding roller pair 126. The bypass tray 124 is a tray on which the sheet P to be manually fed is placed, and is opened on a side surface of the apparatus main body 11 as illustrated in FIG. 1 when the sheet P is manually fed. The pickup roller 125 feeds the sheet P placed on the bypass tray 124. The sheet feeding roller pair 126 sends the sheet P fed by the pickup roller 125 to the sheet conveyance path 111.

The image forming unit 13 forms a toner image to be transferred to the sheet P. and includes a plurality of image forming units that form toner images of different colors. In the present embodiment, the image forming units are a magenta unit 13M which uses magenta (M) developer, a cyan unit 13C which uses cyan (C) developer, a yellow unit 13Y which uses yellow (Y) developer, and a black unit 13Bk which uses black (Bk) developer. The units 13M, 13C, 13Y, and 13Bk are disposed in this order from an upstream side to a downstream side (from left to right illustrated in FIG. 1) in a rotational direction of an intermediate transfer belt 141, described later. The units 13M, 13C, 13Y, and 13Bk each have a photoconductive drum 20 (an image carrier), and a charging device 21, a developing device 23, a primary transfer roller 24, and a cleaning device 25 which are disposed around the photoconductive drum 20. An exposing device 22 which is shared by the units 13M, 13C, 13Y, and 13Bk is disposed below the image forming units.

The photoconductive drum 20 is driven to be rotated about a shaft of the photoconductive drum 20, and carries a toner image obtained by developing an electrostatic latent image which is formed on a surface of the photoconductive drum 20. Examples of the photoconductive drum 20 are a publicly-known amorphous silicon (α-Si) photoconductive drum and an organic photoconductive drum (OPC). The charging device 21 charges the surface of the photoconductive drum 20 uniformly to a predetermined charging potential. The charging device 21 includes a charging roller and a charging cleaning brush which removes toner adhered to the charging roller. The exposing device 22 is disposed downstream in the rotational direction of the photoconductive drum 20 with respect to the charging device 21, and includes various optical systems such as a light source, a polygon mirror, a reflection mirror, and a deflection mirror. The exposing device 22 irradiates the surface of the photoconductive drum 20 charged uniformly to the charging potential with light modulated based on image data (predetermined image information) and exposes the surface of the photoconductive drum 20, thus forming an electrostatic latent image.

The developing device 23 is disposed in a predetermined development nip portion NP (FIG. 3A) downstream in the rotational direction of the photoconductive drum 20 with respect to the exposing device 22 so as to oppose the photoconductive drum 20. The developing device 23 includes a developing roller 231 that is rotated to carry developer including toner and carrier on a peripheral surface of the developing roller 231 and supplies the toner to the photoconductive drum 20 so as to form the toner image.

The primary transfer roller 24 and the photoconductive drum 20 form the nip portion across the intermediate transfer belt 141 provided to the intermediate transfer unit 14. The primary transfer roller 24 primarily transfers the toner image on the photoconductive drum 20 to the intermediate transfer belt 141. The cleaning device 25 cleans the peripheral surface of the photoconductive drum 20 after the transfer of the toner image.

The intermediate transfer unit 14 is disposed in a space between the image forming unit 13 and the toner supply unit 15, and includes the intermediate transfer belt 141, a driving roller 142 which is rotatably supported to a unit frame, not illustrated, a driven roller 143, a backup roller 146, and a density sensor 100. The intermediate transfer belt 141 is an endless belt-shaped rotating body, and is installed across the driving roller 142 and the driven rollers 143 and the backup roller 146 so that a peripheral surface side of the intermediate transfer belt 141 makes contact with the peripheral surfaces of the photoconductive drums 20. The intermediate transfer belt 141 is circularly driven by the rotation of the driving roller 142. A belt cleaning device 144, which removes toner remaining on the peripheral surface of the intermediate transfer belt 141, is disposed near the driven roller 143. The density sensor 100 (the density detecting unit) is disposed downstream with respect to the units 13M. 13C, 13Y, and 13Bk so as to oppose the intermediate transfer belt 141, and detects density of the toner image formed on the intermediate transfer belt 141. In another embodiment, the density sensor 100 may detect density of a toner image on the photoconductive drum 20, or density of a toner image fixed to the sheet P.

A secondary transfer roller 145 (a transfer unit) is disposed outside the intermediate transfer belt 141 so as to oppose the driving roller 142. The secondary transfer roller 145 makes pressure-contact with the peripheral surface of the intermediate transfer belt 141 so that a transfer nip portion is formed between the secondary transfer roller 145 and the driving roller 142. The toner image, which has been primarily transferred to the intermediate transfer belt 141, is secondarily transferred to the sheet P supplied from the sheet feeding unit 12 in the transfer nip portion. That is, the intermediate transfer unit 14 and the secondary transfer roller 145 function as a transfer unit that transfers the toner image carried by the photoconductive drum 20 to the sheet P. Further, a roll cleaner 200 which is used for cleaning the peripheral surface of the driving roller 142 is disposed on the driving roller 142.

In the present embodiment, the toner supply unit 15, which stores toner to be used for forming an image, includes a magenta toner container 15M, a cyan toner container 15C, a yellow toner container 15Y, and a black toner container 15Bk. These toner containers 15M, 15C, 15Y, and 15Bk store M, C, Y, and Bk toner to be supplied, respectively. Toner of respective colors is supplied from a toner discharge port 15H formed on a container bottom surface to the developing devices 23 of the image forming units 13M, 13C, 13Y, and 13Bk corresponding to M, C, Y, and Bk.

The fixing unit 16 includes a heating roller 161 having a built-in heating source, a fixing roller 162 disposed to oppose the heating roller 161, a fixing belt 163 stretched between the fixing roller 162 and the heating roller 161, and a pressure roller 164 which is disposed to oppose the fixing roller 162 via the fixing belt 163 and forms a fixing nip portion. The sheet P supplied to the fixing unit 16 passes through the fixing nip portion so as to be heated and pressurized. This fixes the toner image transferred to the sheet P in the transfer nip portion to the sheet P.

The sheet ejection portion 17 is formed by recessing a top of the apparatus main body 11, and includes an output tray 171 that receives the sheet P ejected to a bottom portion of the recessed portion. The sheet P which has been subject to the fixing process is ejected onto the output tray 171 via the sheet conveyance path 111 which extends from an upper portion of the fixing unit 16.

<Developing Device>

Figure 2:
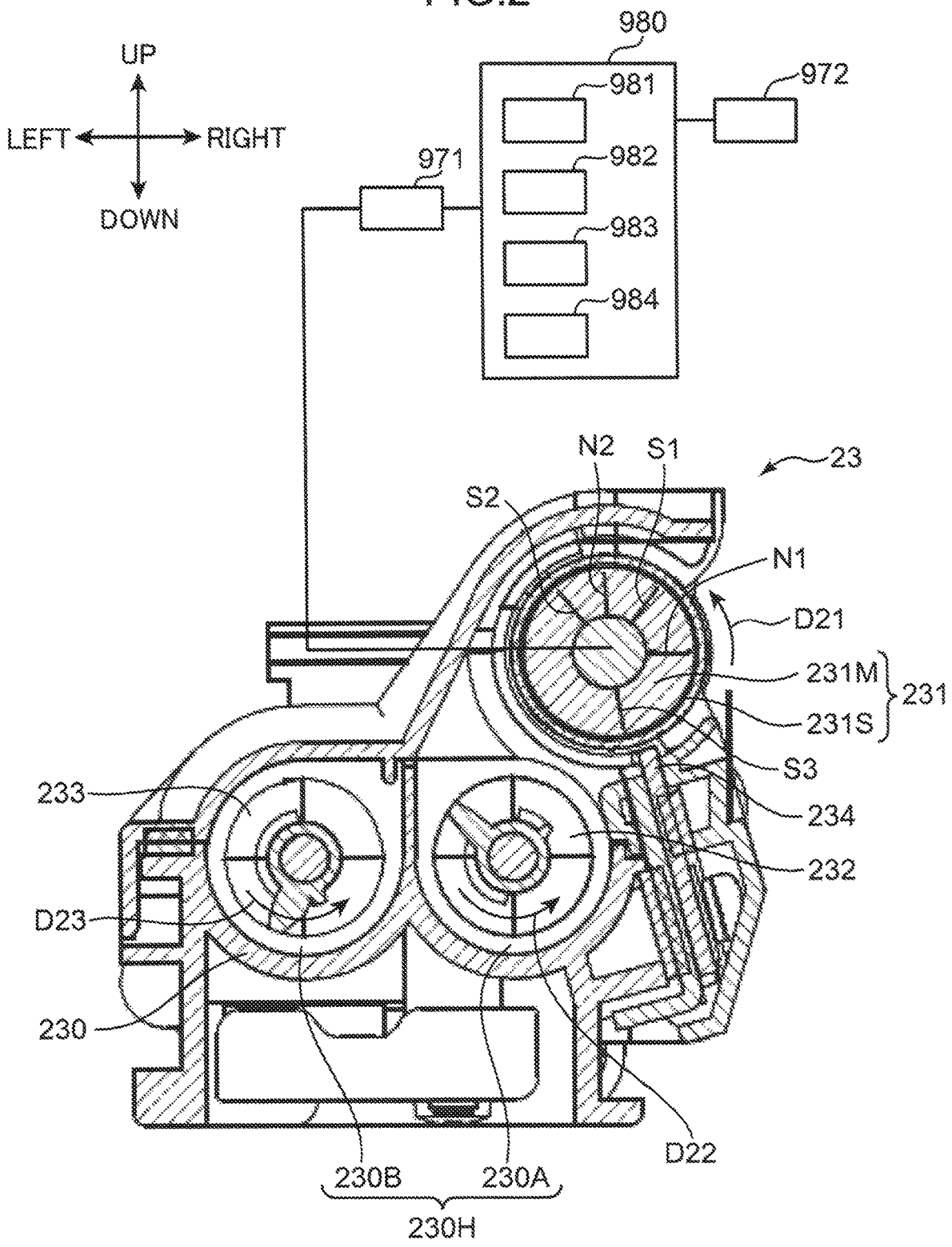
FIG. 2 is a cross-sectional view of a developing device and a block diagram illustrating an electrical configuration of a control unit according to the embodiment of the present disclosure.

FIG. 2 is a cross-sectional view of the developing device 23 and a block diagram illustrating an electrical configuration of a control unit 980 according to the present embodiment. The developing device 23 includes a development housing 230, the developing roller 231, a first screw feeder 232 (an agitating member), a second screw feeder 233 (an agitating member), and a regulating blade 234. The developing device 23 employs a two-component developing method.

The development housing 230 has a developer housing portion 230H. The developer housing portion 230H houses two-component developer including toner and carrier. The developer housing portion 230H includes a first conveyance portion 230A and a second conveyance portion 230B. The first conveyance portion 230A conveys the developer to a first conveyance direction from one end of a axial direction of the developing roller 231 to the other end (a direction perpendicular to a sheet surface of FIG. 2, namely, a rear-front direction). The second conveyance portion 230B, which is communicated with the first conveyance portion 230A at both the ends in the axial direction, conveys the developer to a second conveyance direction opposite to the first conveyance direction. The first screw feeder 232 and the second screw feeder 233 are rotated to directions indicated by arrows D22 and D23 in FIG. 2, respectively, so as to convey the developer to the first conveyance direction and the second conveyance direction, respectively. In particular, the first screw feeder 232 supplies the developer to the developing roller 231 while conveying the developer to the first conveyance direction.

Figure 3A:
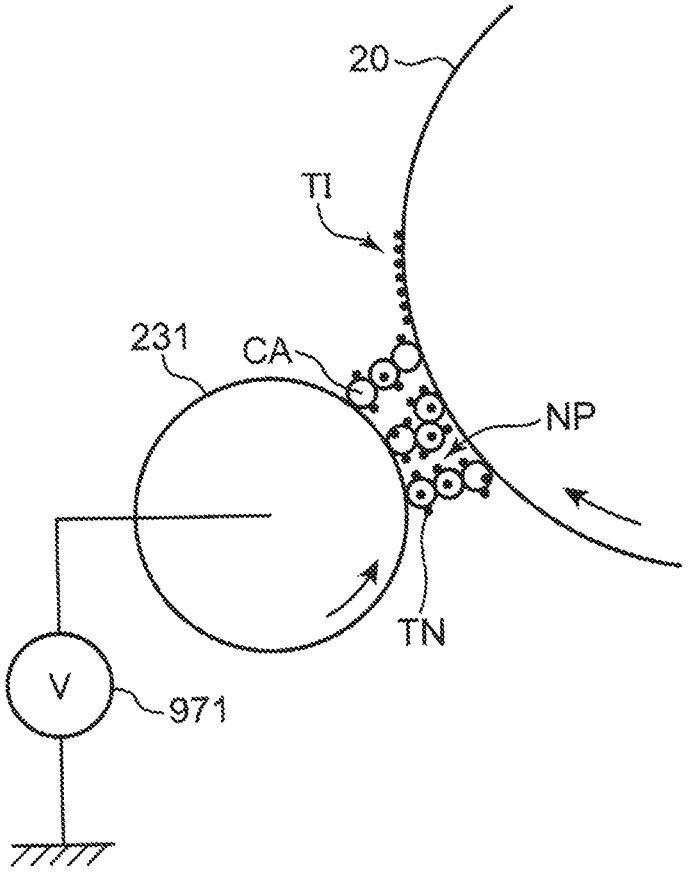
FIG. 3A is a pattern diagram illustrating a developing operation of the image forming apparatus according to the embodiment of the present disclosure.

The developing roller 231 is disposed so as to oppose the photoconductive drum 20 in the development nip portion NP (FIG. 3A). The developing roller 231 includes a sleeve 231S to be rotated, and a magnet 231M which is stationarily disposed inside the sleeve 231S. The magnet 231M has S1, N1, S2, N2, and S3 poles. The N1 pole functions as a main pole, the S1 and N2 poles function as conveyance poles, and the S2 pole functions as a peeling pole. The S3 pole functions as a draw-up and regulating pole. In one example, magnetic flux density of the S1, N1, S2, N2, and S3 poles is set to 54 mT, 96 mT, 35 mT, 44 mT, and 45 mT, respectively. The sleeve 231S of the developing roller 231 is rotated to a direction indicated by arrow D21 in FIG. 2. The developing roller 231 is rotated, receives the developer in the development housing 230, carries a developer layer, and supplies toner to the photoconductive drum 20. In the present embodiment, the developing roller 231 rotates to an identical direction (a width direction) in a position opposing to the photoconductive drum 20.

The regulating blade 234 is disposed to be away from the developing roller 231 by a predetermined space, and regulates a layer thickness of the developer supplied from the first screw feeder 232 to the peripheral surface of the developing roller 231.

The image forming apparatus 10 having the developing device 23 further includes a development bias applying unit 971, a driving unit 972, and the control unit 980. The control unit 980 includes a central processing unit (CPU), a read only memory (ROM) that stores a control program, a random access memory (RAM) that is used as a work area of the CPU.

The development bias applying unit 971, which includes a direct-current power source and an alternating-current power source, applies a development bias, which is obtained by superimposing an alternating current voltage on a direct current voltage, to the developing roller 231 of the developing device 23 based on a control signal from a bias control unit 982, described later.

The driving unit 972, which includes a motor and a gear mechanism that transmits a torque of the motor, drives to rotate the developing roller 231, the first screw feeder 232, and the second screw feeder 233 in the developing device 23 as well as the photoconductive drum 20 during the developing operation in accordance with a control signal from a driving control unit 981, described later.

The control unit 980 is configured to include the driving control unit 981, the bias control unit 982, a storage unit 983, and a mode control unit 984 by the CPU executing the control program stored in the ROM.

The driving control unit 981 controls the driving unit 972, and drives to rotate the developing roller 231, the first screw feeder 232, and the second screw feeder 233. The driving control unit 981 controls a driving mechanism, not illustrated, and drives to rotate the photoconductive drum 20.

The bias control unit 982 controls the development bias applying unit 971 during the developing operation for supplying toner from the developing roller 231 to the photoconductive drum 20, and causes a potential difference in the direct current voltage and the alternating current voltage between the photoconductive drum 20 and the developing roller 231. The potential difference moves the toner from the developing roller 231 to the photoconductive drum 20.

The storage unit 983 stores various information to be seen by the driving control unit 981 and the bias control unit 982. An example of the stored information is a value of the development bias to be adjusted in accordance with a number of rotations of the developing roller 231 and an environment. The storage unit 983 stores reference information, which relates to a tilt of the reference straight line representing a relationship between a change amount of a frequency of the alternating current voltage of the development bias and a density change amount of the toner image in a case where the frequency is changed with the potential difference in the direct current voltage between the developing roller 231 and the photoconductive drum 20 being kept constant, for each toner charging amount in advance. Data to be stored in the storage unit 983 may be a graph or a table. Other data stored in the storage unit 983 will be described later.

The mode control unit 984 (the developer information acquisition unit) executes a charging amount measuring mode (a second measurement toner image forming operation and a toner charging amount acquisition operation) and a developer life predicting mode (a first measurement toner image forming operation and a developer deterioration information acquisition operation), described later. Execution timing is set for the respective modes in advance, and is stored in the storage unit 983. The mode control unit 984 may execute or start the above respective modes in response to a request from maintenance staff of the image forming apparatus 10 without delay. In the charging amount measuring mode, the mode control unit 984 continuously forms a measurement toner image on the photoconductive drum 20 at a predetermined timing where the image forming operation is not performed, while changing the frequency of the alternating current voltage of development bias with the potential difference in the direct current voltage between the developing roller 231 and the photoconductive drum 20 being kept constant (the second measurement toner image forming operation). In the charging amount measuring mode, the mode control unit 984 acquires a tilt of a measurement straight line representing a relationship between the change amount of the frequency in the second measurement toner image forming operation and the density change amount of the measurement toner image based on the change amount of the frequency in the second measurement toner image forming operation and the result of detecting density of the measurement toner image in the density sensor 100, and acquires a charging amount of toner included in the measurement toner image formed on the photoconductive drum 20 at the predetermined timing based on the acquired tilt of the measurement straight line and the reference information in the storage unit 983 (the toner charging amount acquisition operation).

In the developer life predicting mode, the mode control unit 984 performs an operation for controlling the development bias applying unit 971 at a plurality of timings between which at least the image forming operation is performed to form a measurement toner image on the photoconductive drum 20. In this operation, the mode control unit 984 keeps the potential difference in the direct current voltage between the developing roller 231 and the photoconductive drum 20 constant at the plurality of timings, varies the frequency of the alternating current voltage of the development bias so as to form the measurement toner image on the photoconductive drum 20 at the plurality of timings (the first measurement toner image forming operation). In the developer life predicting mode, the mode control unit 984 acquires a tilt of a measurement straight line representing the relationship between the change amount of the frequency in the first measurement toner image forming operation and the density change amount of the measurement toner image based on the change amount of the frequency in the first measurement toner image forming operation and the result of detecting density of the measurement toner image in the density sensor 100, and acquires toner charging amounts acquired at the plurality of timings based on the acquired tilt of the measurement straight line and the reference information in the storage unit 983 so as to acquire information relating to deterioration of the developer based on the acquired toner charging amount (the developer deterioration information acquisition operation). These operations performed by the mode control unit 984 will be described in detail below.

Figure 3B:
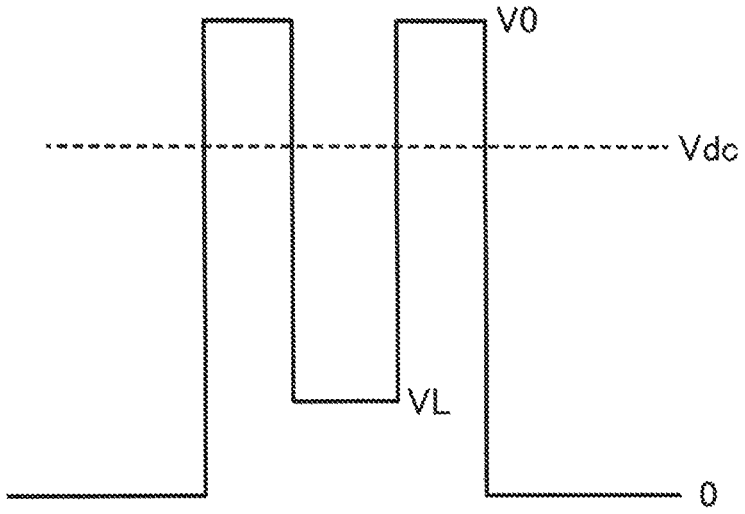
FIG. 3B is a pattern diagram illustrating a level relationship between potentials of an image carrier and a developing roller according to the embodiment of the present disclosure.

FIG. 3A is a pattern diagram of a developing operation in the image forming apparatus 10 according to the present embodiment, and FIG. 3B is a pattern diagram illustrating a level relationship in an electric potential between the photoconductive drum 20 and the developing roller 231. With reference to FIG. 3A, the development nip portion NP is formed between the developing roller 231 and the photoconductive drum 20. Toner TN and carrier CA which are carried on the developing roller 231 form a magnetic brush. In the development nip portion NP, the toner TN is supplied from the magnetic brush to the photoconductive drum 20, and a toner image TI is formed. With reference to FIG. 3B, the surface of the photoconductive drum 20 is charged to a background portion potential VO (V) by the charging device 21. Thereafter, when the exposing device 22 emits exposure light, the surface potential of the photoconductive drum 20 is changed from the background portion potential VO to at most an image portion potential VL (V) in accordance with the image to be printed. On the other hand, a direct current voltage Vdc of the development bias is applied to the developing roller 231, and an alternating current voltage, not illustrated, is superimposed on the direct current voltage Vdc.

In a case of such a reversal developing method, a potential difference between the surface potential VO and the direct-current component Vdc of the development bias is a potential difference that suppresses toner fogging on the background portion of the photoconductive drum 20. On the other hand, a potential difference between a surface potential VL after exposure and the direct-current component Vdc of the development bias is a developing potential difference for moving toner of plus polarity to an image portion of the photoconductive drum 20. The alternating current voltage to be applied to the developing roller 231 improves the transfer of the toner from the developing roller 231 to the photoconductive drum 20.

On the other hand, toner is triboelectrically charged due to carrier while being circularly conveyed in the development housing 230. Each of The toner charging amounts has an effect on an amount of toner (a developing amount) moving to the photoconductive drum 20 due to the development bias. Therefore, when the toner charging amount can be accurately predicted in the image forming apparatus 10, the development bias and the toner density are adjusted in accordance with a number of sheets to be printed, a change in environment, a printing mode, and a page-coverage rate so that satisfactory image quality can be maintained. Thus, accurate prediction of the toner charging amount has been desired.

<Prediction of Toner Charging Amount>

The disclosers have continued to earnestly conduct a study in view of the above situation, and have gained a new insight that when the frequency of the altemating current voltage of the development bias is changed, the change in the toner developing amount varies depending on the toner charging amount. Specifically, when the toner charging amount is small, an increase in the frequency of the alternating current voltage causes an increase in the toner developing amount. On the other hand, the disclosers have gained a new insight that when the toner charging amount is high, an increase in the frequency of the alternating current voltage causes a decrease in the toner developing amount. With use of this characteristic, the change in the image density in the case where the frequency of the alternating current voltage is changed is measured, and thus the toner charging amount can be accurately predicted.

Figure 4:
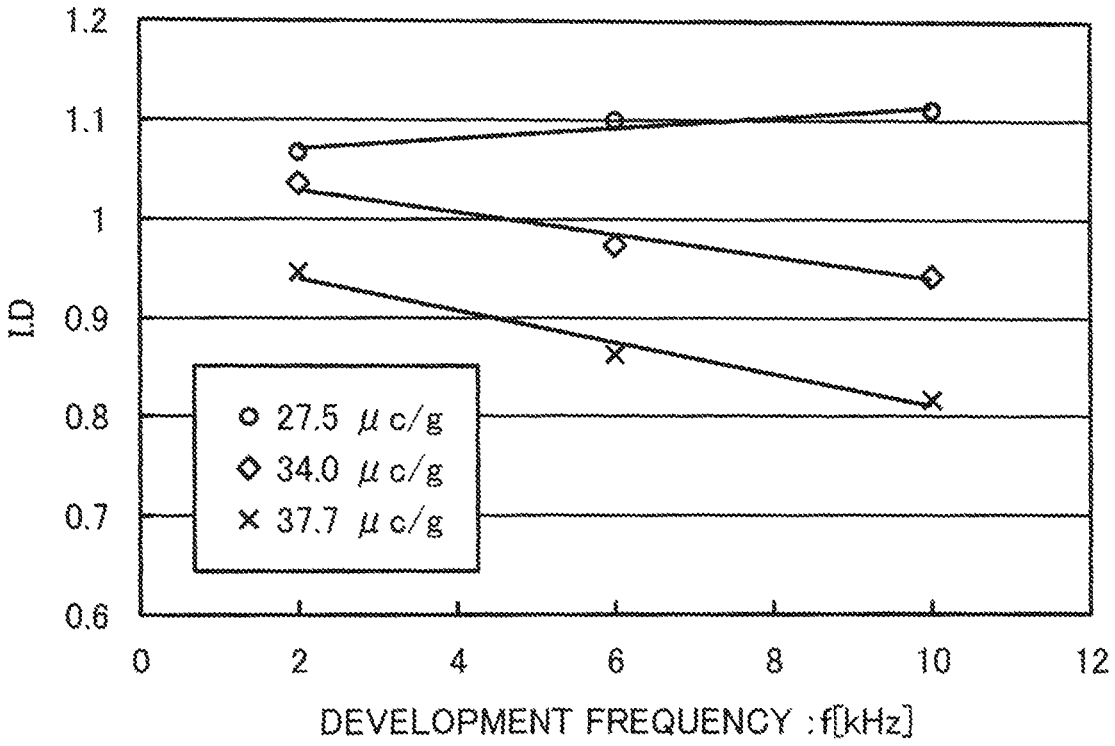
FIG. 4 is a graph illustrating a relationship between a frequency of a development bias and image density in the image forming apparatus according to the embodiment of the present disclosure.
Figure 5:
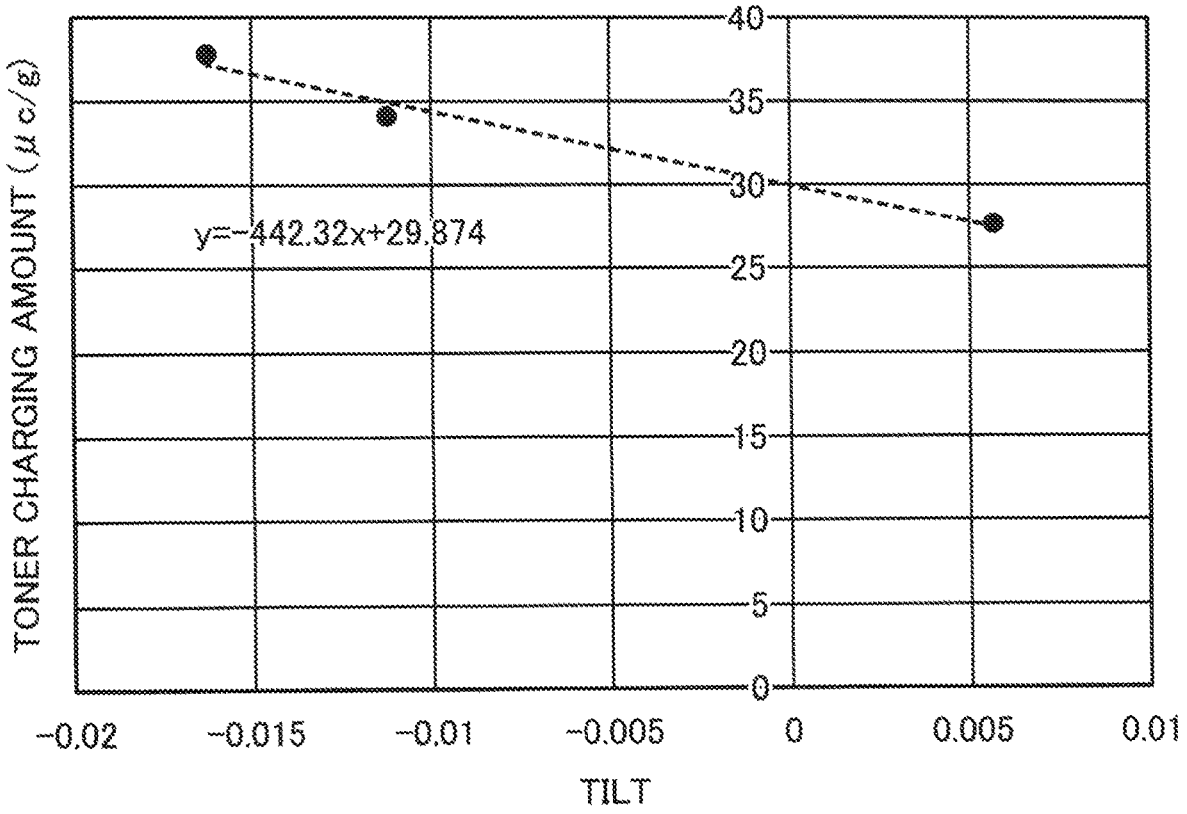
FIG. 5 is a graph illustrating a relationship between a tilt in the graph of FIG. 4 and a toner charging amount in the image forming apparatus according to the embodiment of the present disclosure.

FIG. 4 is a graph illustrating a relationship between the frequency of the development bias and the image density in the image forming apparatus 10 according to the present embodiment. FIG. 5 is a graph illustrating a relationship between the tilt in the graph of FIG. 4 and the toner charging amount in the image forming apparatus 10 according to the present embodiment.

A potential difference between the direct current voltage of the development bias to be applied to the developing roller 231 and the direct current voltage of the electrostatic latent image on the photoconductive drum 20 is kept constant, and a frequency of an alternating current voltage of the development bias is changed with a peak-to-peak voltage Vpp and a duty ratio of the alternating current voltage being fixed. This results in a tendency that the toner image density detected by the density sensor 100 varies in accordance with the toner charging amount on the developing roller 231 (FIG. 4). That is, as illustrated in FIG. 4, when the toner charging amount is 27.5 μc/g, a low frequency f causes a decrease in the image density. On the other hand, when the toner charging amounts are 34.0 μc/g and 37.7 μc/g, the low frequency f causes an increase in image density. As the toner charging amount is smaller, the tilt in the graph illustrated in FIG. 4 is greater. With reference to FIG. 5, relationships between three tilts in the graph of FIG. 4 and the respective toner charging amounts are represented by straight lines (approximation straight lines). Thus, when information illustrated in FIG. 5 is stored in the storage unit 983 in advance and the tilts of the straight lines illustrated in FIG. 4 are derived in the charging amount measuring mode, described later, the toner charging amount at that time can be measured (predicted).

<Toner Charging Amount Predicting Effect>

In the present embodiment, a surface potential sensor that measures the surface potential of the photoconductive drum 20 does not need to be disposed to predict the toner charging amount. An electric current which flows into the developing roller 231 does not need to be measured in accordance with the development bias for predicting the toner charging amount. The toner charging amount can be stably predicted without any effect of a change in the electric current flowing into the developing roller 231 due to soiling of the surface potential sensor and a change in carrier resistance. This prediction makes selection of a desirable method easy in a case where the density of an image to be printed in the image forming apparatus 10 is decreased. In one desirable method, an increase in the toner density of the developing device 23 causes a reduction in the toner charging amount and thus causes an increase in the image density. In the other method, an increase in a developing potential difference (Vdc−VL) in the development nip portion NP causes the increase in the image density.

In general, the reduction in the image density in the image forming apparatus 10 is caused by, for example, "a reduction in the developing potential difference", "a reduction in a conveyance amount of the developer passing through the regulating blade 234", "a rise in the carrier resistance", and "a rise in the toner charging amount". With such a method, the increase in the toner density for reducing the toner charging amount in response to the reduction in the image density caused by a factor other than the increase in the toner charging amount might cause a defect such as toner flying. The toner charging amount is desirably reduced by increasing the toner density in response to the reduction in the image density caused by the increase in the toner charging amount, and a developing electric field (the development bias) is desirably increased in response to the reduction in the image density caused by another factor. Acquisition of the toner charging amount enables optimization of a transfer current to be applied to the secondary transfer roller 145, thus enabling a whole system of the image forming apparatus 10 to be stable.

<Relationship Between Frequency and Toner Charging Amount>

The discloser of the present disclosure estimates that the toner charging amount contributes to the change in the image density in the case where the frequency of the alternating current voltage of the development bias is changed as described below.

(1) Case of Small Toner Charging Amount

In the case of the small toner charging amount, electrostatic adhesion which acts between the toner and the carrier is small, and thus the toner is easily separated from the carrier. However, when the frequency of the alternating current voltage of the development bias is low, a number of toner reciprocating times in the development nip portion NP is decreased. This decrease causes a reduction in the image density. The decrease in the frequency increases a reciprocating distance of the toner per cycle of the alternating current voltage, but in the case of the small toner charging amount, an effect on the decrease in the image density is small because a toner moving distance is originally short. In the case of the small toner charging amount, when the frequency of the alternating current voltage of the development bias is decreased, the image density is decreased.

(2) Case of Large Toner Charging Amount

The low frequency of the alternating current voltage of the development bias decreases the number of toner reciprocating times in the development nip portion NP, but in the case of the large toner charging amount, an effect of the decrease in the number of the reciprocating times is small because originally the toner is hardly separated from the carrier. On the other hand, the low frequency increases the toner reciprocating distance per cycle of the alternating current voltage, and thus the image density increases in accordance with the large toner charging amount. In the case of the large toner charging amount, when the frequency of the alternating current voltage of the development bias is decreased, the image density increases.

<Toner Charging Amount Measuring Mode>

Figure 6:
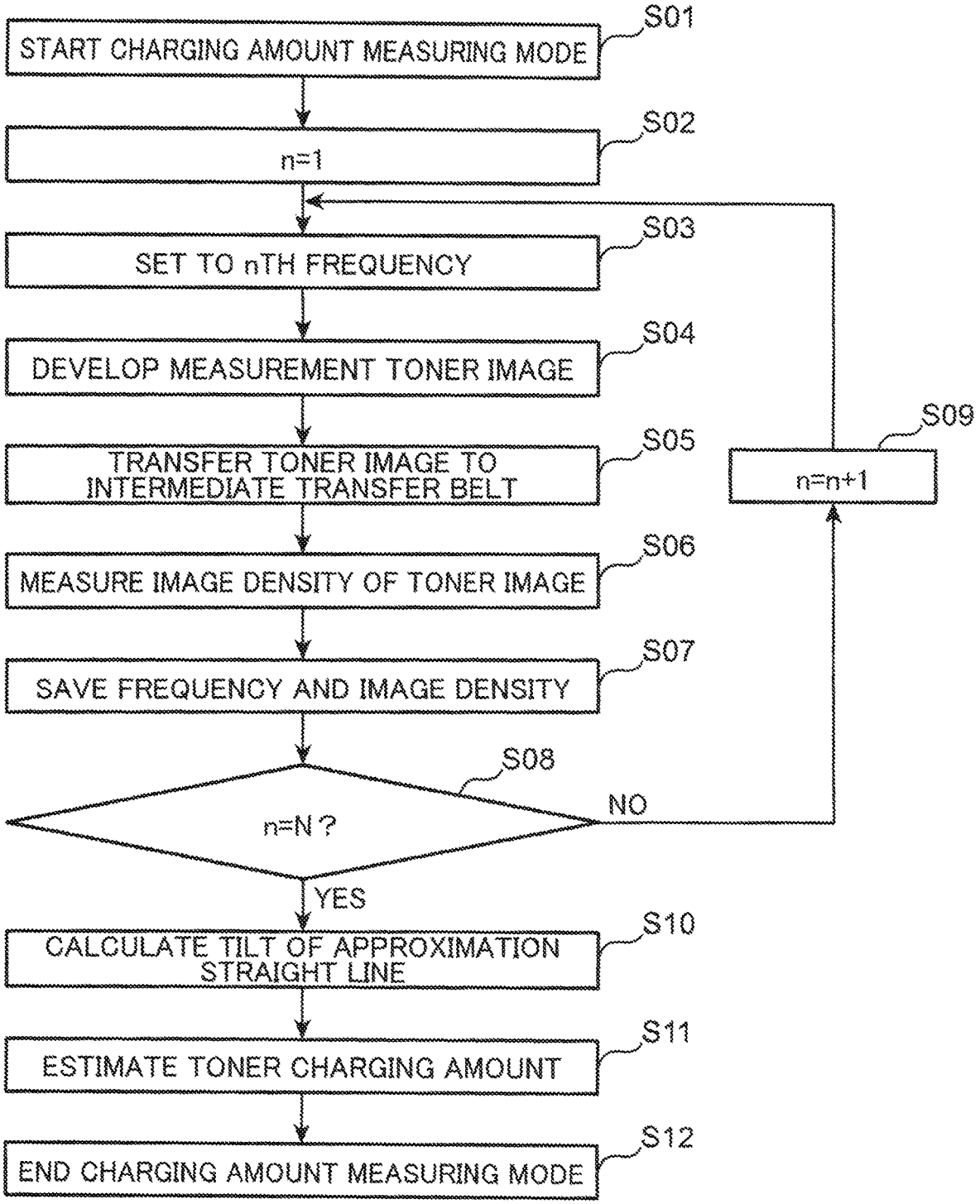
FIG. 6 is a flowchart illustrating a charging amount measuring mode to be executed in the image forming apparatus according to the embodiment of the present disclosure.
Figure 7:
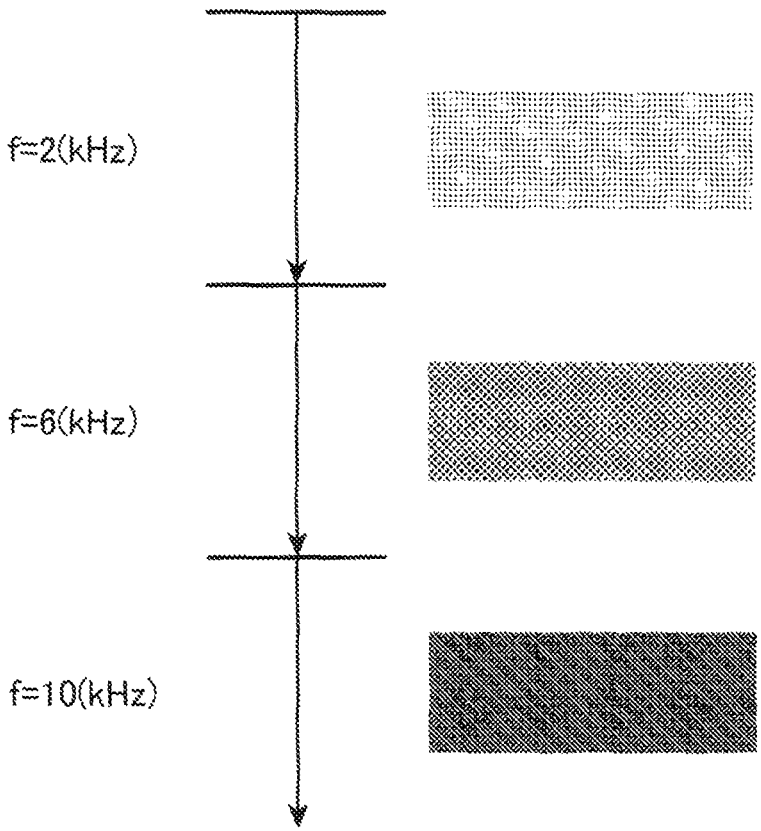
FIG. 7 is a pattern diagram illustrating a measurement toner image to be formed on the image carrier in the charging amount measuring mode to be executed in the image forming apparatus according to the embodiment of the present disclosure.

FIG. 6 is a flowchart illustrating the charging amount measuring mode to be executed in the image forming apparatus 10 according to the present embodiment. FIG. 7 is a pattern diagram of the measurement toner image to be formed on the photoconductive drum 20 in the charging amount measuring mode. A flow of FIG. 6 includes the second measurement toner image forming operation and the toner charging amount acquisition operation.

With reference to FIG. 6, when the charging amount measuring mode starts (step S01), the mode control unit 984 sets a variable n for changing the frequency of the alternating current voltage of the development bias to 1 (step S02). The mode control unit 984 controls the driving control unit 981 and the bias control unit 982, and after rotating the developing roller 231 once or more with a preset reference development bias being applied, sets the frequency of the alternating current voltage of the development bias to a first frequency (n=1) (step S03). The reference development bias is set for preventing the charging amount measuring mode from being affected by a history of previous image forming. Normally, a bias to be used for printing (image forming) is applied to a condition of the reference development bias. It is desirable that the direct current voltage and the alternating current voltage are applied in a superimposed manner because of a less eliminating effect for the history when only the direct current voltage is applied as the reference development bias.

The preset measurement toner image is developed at the development bias with which the frequency of the alternating current voltage is set to the first frequency (step S04), and this toner image is transferred from the photoconductive drum 20 to the intermediate transfer belt 141 (step S05). Image density of the measurement toner image is measured by the density sensor 100 (step S06), and the acquired image density as well as the first frequency value is stored in the storage unit 983 (step S07).

The mode control unit 984 then determines whether the variable n relating to the frequency reaches a preset prescribed number of times N (step S08). If a relation of $n \neq N$ is satisfied (NO in step S08), the value n is counted up by 1 (n=n+1 in step S09), and steps S03 to S07 are repeated. It is desirable for heightening the measuring accuracy of the charging amount that the prescribed number of times N is 2 or more, and more desirably set to satisfy a relation of $3 \leq N$. On the other hand, if a relation of n=N is satisfied (YES in step S08), the mode control unit 984 calculates tilts of the approximation straight lines illustrated in FIG. 4 based on the information stored in the storage unit 983 (step S10). The mode control unit 984 estimates the toner charging amount from the tilts (step S11) based on the graph (the reference information), illustrated in FIG. 5, stored in the storage unit 983, and ends the charging amount measuring mode (step S12).

FIG. 7 illustrates an example that when the prescribed number of times N is 3, the frequency f is increased, and thus the image density of the measurement toner image is increased. In this case, the toner charging amount is relatively small as in 27.5 μc/g in FIG. 4.

When N is 2, the image density measured in step S06 is defined as ID1 and ID2. The first frequency is defined as f1 (kHz), and the second frequency is defined as f2 (kHz) (f2<f1). In this case, a tilt La of a straight line illustrated in FIG. 4 is calculated by expression 1.

$$La=(ID1-ID2)/(f1-f2) \quad \text{(expression 1)}$$

The tilt La in the expression 1, which varies with the toner charging amount, becomes "positive (+)" in the small toner charging amount, and becomes "negative (−)" in the large toner charging amount. When the measurement is conducted under the condition that $3 \leq N$, a tilt of the approximation straight lines in a linear expression obtained by a method of least squares may be used. The reference information illustrated in FIG. 5 is expressed by expression 2.

$$Q/M=A \times La+B \quad \text{(expression 2)}$$

Symbols A and B are values specific to developer, and are determined in advance by an experiment. Symbol Q/M means the toner charging amount per unit mass. When the tilt La of the approximation straight line calculated by the expression 1 in step S10 is assigned to the expression 2, the toner charging amount Q/M is calculated. The charging amount measuring mode illustrated in FIG. 6 may be executed for the developing devices 23 of the respective colors in FIG. 1, and the frequency set during the mode may be set to values specific to the developing devices 23. In particular, when desirable frequencies in accordance with temperature and humidity around the image forming apparatus 10 and a number of durable sheets have been already known, the frequency to be set during the mode may be set near the already known frequency. A frequency to be used for a new measuring mode may be selected with reference to the result of the charging amount measuring mode for the previous toner. In this case, the accuracy of the toner charging amount to be measured can be heightened.

<Execution Timing of Charging Amount Measuring Mode>

The charging amount measuring mode according to the present embodiment is automatically started and manually started at different timings. It is desirable that the automatic measuring mode is executed at the same timing as a calibration operation by the image forming apparatus 10 (referred to also as a setting-up operation or an image quality adjusting operation). In the calibration operation, the adjusting operation is sufficiently performed for obtaining satisfactory image quality in an intermediate density region (a halftone image). For this operation, a time period required by executing the charging amount measuring mode is sufficiently secured. Therefore, the measuring mode can be executed at the altemating current voltage of the development bias with two different frequencies. In the calibration operation, a halftone image as well as a solid image (100% solid image) is also used as an image pattern for adjusting the image quality. Thus, the predicting accuracy of the toner charging amount can be improved. In the solid image in a high density region, a developing performance in the development nip portion NP is saturated more easily than that in the halftone image. That is, a change amount of the image density is small in the case where the development bias is changed (a sensitivity is low). On the other hand, in the halftone image, the toner charging amount is accurately measured (predicted) because the change amount of the image density is comparatively large. In the case of the halftone image, the density sensor 100 might detect the image density with comparatively low accuracy because the density is relatively low in the halftone image than in the solid image. Therefore, the charging amount measuring mode is executed for both the solid image and the halftone image, and an average value is taken from these images, thus enabling the measurement with higher accuracy. The values A and B in the expression 2 are different between the solid image and the halftone image. This is because a relationship between the image density and the toner developing amount is different between the solid image and the halftone image.

It is desirable that a plurality of the density sensors 100 are disposed in a main scanning direction (the axial direction of the photoconductive drum 20) and measurement toner images are formed in accordance with the positions of the density sensor 100. That is, in a case where a measurement toner image is formed corresponding to both the ends in the axial direction of the photoconductive drum 20, the toner charging amounts at both the ends of the developing device 23 (the developing roller 231), respectively, can be predicted. If a difference in the toner charging amount between both the ends is larger than a preset threshold, charging performance might be deteriorated in the developing device 23. The mode control unit 984 thus can facilitate replacement of the developing device 23 and replacement of developer through a display unit, not illustrated, of the image forming apparatus 10.

It is desirable that the charging amount measuring mode is executed is executed when the image forming apparatus 10 is manufactured and is shipped from a factory and when the main body of the image forming apparatus 10 is set up in a place where the image forming apparatus 10 is used. This enables prediction of an influence during suspension of the image forming apparatus 10. That is, the charging amount of the developer tends to be small when the suspension period is long, and a tendency level varies with a period and an environment in which the image forming apparatus 10 is left. Therefore, the measurement of the toner charging amount at the shipment time and the main body setup time enables prediction of a deteriorated state of the developer due to the state that the developer is left. If the image forming apparatus 10 is left for a very long period or left in a hostile environment, a great difference between the two toner charging amounts (the toner charging amounts at the shipment time and the main body setup time) is detected. In such a case, replacement of the developer can be facilitated in the place of use, similarly as described above.

On the other hand, even if the toner charging amounts at the shipment time and the main body setup time are small, the developer is less likely to be deteriorated when the difference between the toner charging amounts is small. Thus, the developer does not have to be replaced in the place of use, and adjustment of the toner density and a developing condition (the development bias, etc.) can improve image quality. The charging amount measuring mode according to the present embodiment is executed after the image forming apparatus 10 is not used and left for a predetermined time period, thus acquiring a change in state of the developer.

In the charging amount measuring mode according to the present embodiment, the toner charging amounts in the developing devices 23 can be acquired without using the surface potential sensor that measures potentials on the photoconductive drum 20 and an ammeter that measures developing currents flowing into the developing rollers 231. The information relating to deterioration of the developer can be then acquired based on the acquired toner charging amount. The acquired results enable an accurate determination whether the replacement of the developer in the developing devices 23 is necessary and an accurate determination whether adjustment of the development bias is necessary.

In particular, the reference information stored in the storage unit 983 is set such that when the toner charging amount is the first charging amount, the tilt of the reference straight line is negative, when the toner charging amount is the second charging amount smaller than the first charging amount, the tilt of the reference straight line is positive, and as the toner charging amount becomes smaller, the tilt of the reference straight line is greater. Such a configuration enables the accurate toner charging amounts to be acquired based on a relationship between the frequency of the alternating current voltage of the development bias and the density of toner images (the development toner amount) to be formed on the photoconductive drums 20 (the intermediate transfer belt 141). Also in the developer life predicting mode, described later, the similar information is referred.

<Developer Life Predicting Mode>

The disclosers have gained a new insight that when the frequency of the alternating current voltage of the development bias is changed, the change in the toner developing amount varies depending on the toner charging amount. The disclosers have gained an insight that a decrease in the toner charging amount caused by carrier deterioration (developer deterioration) can be predicted by arranging a procedure for acquiring frequency characteristics. Specifically, when image density is acquired while the frequency of the alternating current voltage of the development bias is being changed, the image density is not acquired by continuously changing the frequency of the development bias unlike the charging amount measuring mode. That is, the image density is acquired by changing the frequency at every time of printing several to several thousands of sheets at certain time intervals, and the toner charging amount is predicted based on the frequencies and the image density data.

Figure 8:
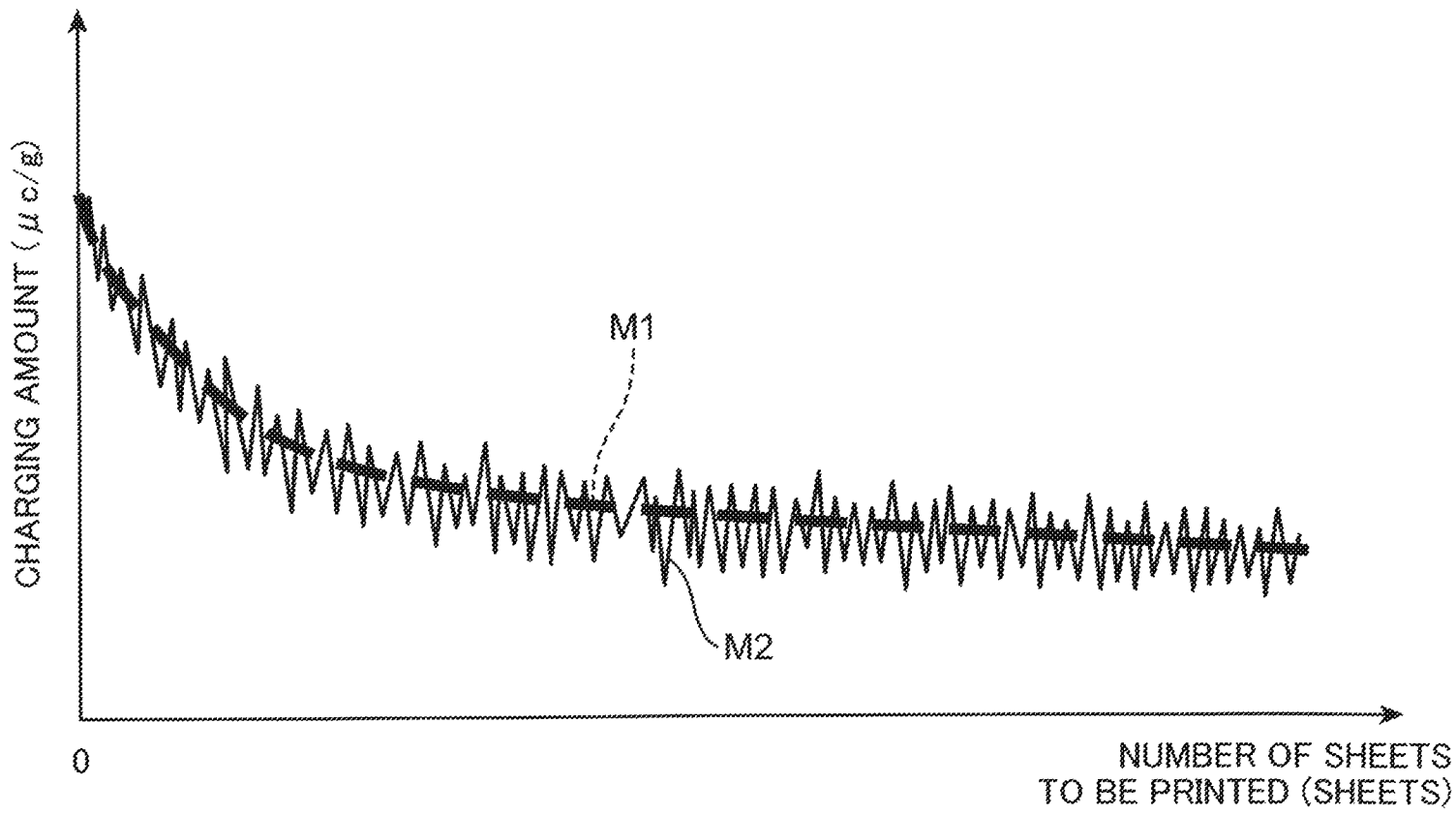
FIG. 8 is a graph illustrating transition M1 of a toner charging amount in accordance with deterioration of developer, and transition M2 of a toner charging amount in accordance with image forming.

Such a data acquiring method is based on two patterns of the toner charging amount. That is, the change in the toner charging amounts includes a short-term change caused by deterioration of toner and a long-term change caused by deterioration of carrier. FIG. 8 is a graph illustrating two transitions of the toner charging amount, namely, illustrating transition M1 of the toner charging amount in accordance with deterioration of carrier and transition M2 of the toner charging amount in accordance with image forming (deterioration of toner). The change in the charging amount due to the deterioration of toner is a phenomenon such that toner characteristics change due to a stress during a developing process from supply of toner to the developing device 23 to supply of the toner to the photoconductive drum 20, and thus the toner charging amount increases or decreases. On the other hand, the change in the charging amount caused by deterioration of carrier is a phenomenon such that the toner charging amount changes due to a change in frictional charging characteristics of carrier caused by coating cut or contamination of coating, and thus the toner charging amount changes over a long term. In FIG. 8, the toner charging amount is decreased over a long term in accordance with deterioration of carrier (M1), and the toner charging amount is changed in accordance with deterioration of toner in a procedure of passing in the developing device 23 (M2). The latter change depends also on a time period during which toner remains (circulates) in the developing device 23. Thus, when a printing ratio (image density) at a time of image forming changes, a time period from flowing of toner into the developing device 23 to supply of the toner to the photoconductive drum 20, in other words, a retention time period of toner in the developing device 23 also changes. As a result, as indicated by M2 in FIG. 8, a short-term toner charging amount changes momently.

When the frequency of the alternating current voltage of the development bias is continuously changed at predetermined timings and the charging amount measuring mode is executed, the toner charging amount including influences of both toner deterioration and carrier deterioration can be measured. On the other hand, when the frequency of the alternating current voltage of the development bias is changed and data is acquired over time while the image forming operation is performed during the acquisition, transition of the toner charging amount in accordance with deterioration of carrier can be acquired with a short-term changing influence of deterioration of toner being suppressed.

Data is acquired when the frequency is continuously changed in the short term, and data is acquired when the frequency is changed in the long term. Therefore, influences of both deterioration of toner with respect to the toner charging amount and deterioration of carrier can be acquired.

It is desirable for a short-term change in the toner charging amount in accordance with deterioration of toner that a countermeasure is taken against a defect such as a density change by adjustment of the development bias with immediate effect. It is effective for a long-term change in the toner charging amount in accordance with deterioration of carrier that a countermeasure is taken against a defect such as a density change by a countermeasure, such as changing a target value of the toner density, requiring a predetermined time period until an effect is produced. For example, when the image density is low because of a large toner charging amount, the target value of the toner density may be set based on the toner charging amount acquired in the developer life predicting mode. It is desirable that when the sufficient image density cannot be obtained by the setting of the target value, the development bias is adjusted based on the toner charging amount obtained in the charging amount measuring mode.

The developer life predicting mode according to the present embodiment will be described in more detail below. The developer life predicting mode is characterized by timing at which the frequency of the development bias is changed and a plurality of image density data are acquired. Thus, from a viewpoint of continuity of the acquisition timing of the density data of a measurement toner image with respect to the frequencies, the charging amount measuring mode is referred to as a continuous mode, and the developer life predicting mode is referred to as a discontinuous mode. In the developer life predicting mode, when the image density of the measurement toner image for one frequency of the alternating current voltage of the development bias is acquired, the process once returns to the normal printing mode. Thereafter, when the printing operation for a predetermined number of sheets or a predetermined condition is achieved, the frequency of the alternating current voltage of the development bias is varied, the measurement toner image is formed, and density data of the measurement toner image is acquired. Thereafter, the process returns to the normal printing mode again.

Such an operation is repeated at several numbers of times, tilts of measurement straight lines are acquired from the image density data for the respective frequencies similarly in the charging amount measuring mode, and the toner charging amount is predicted. In the developer life predicting mode, necessary data is acquired over a long time, and thus a change in the toner charging amount caused by deterioration of carrier can be predicted without being affected by the change in the toner charging amount caused by deterioration of toner.

Figure 9:
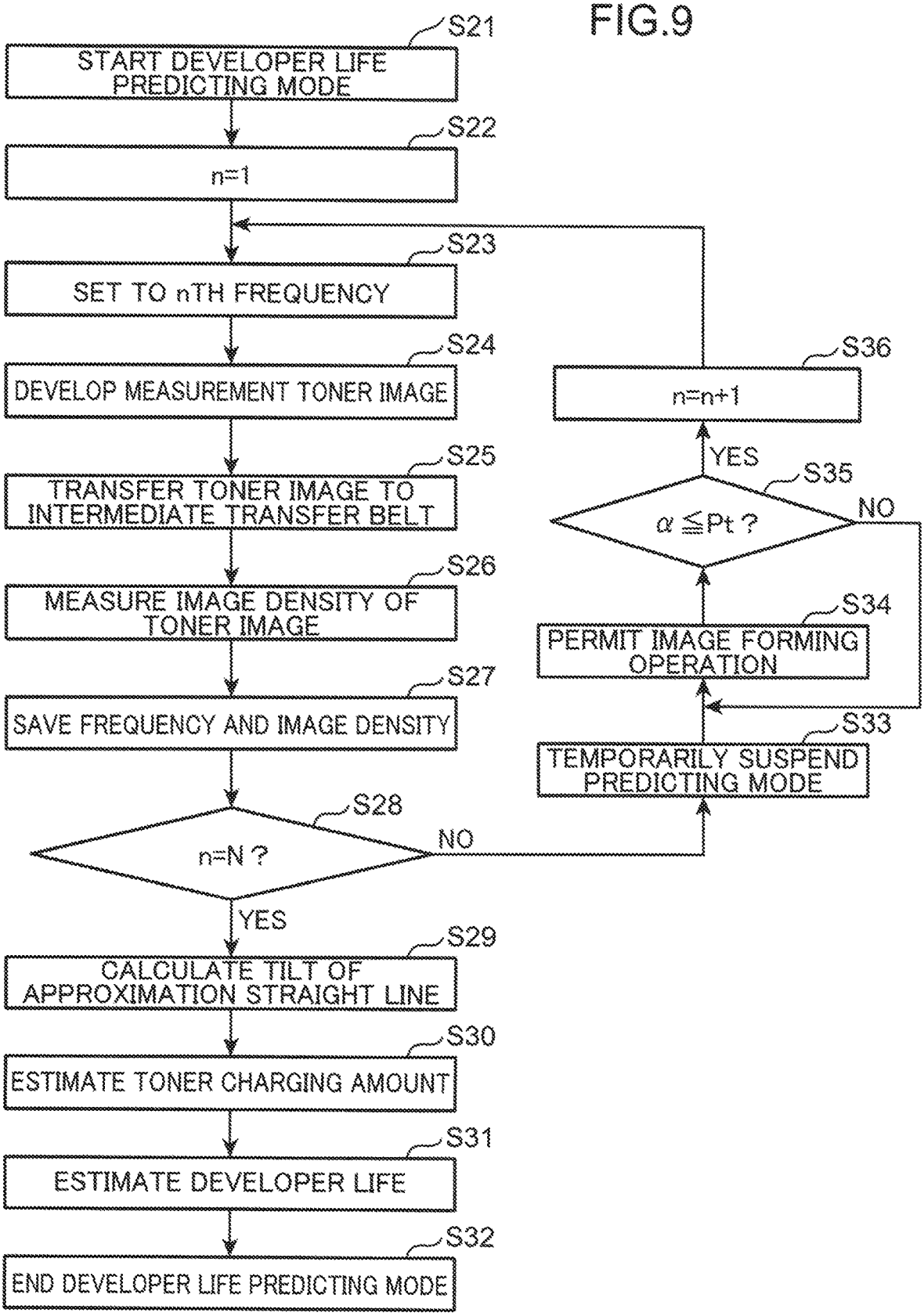
FIG. 9 is a flowchart illustrating a developer life predicting mode to be executed in the image forming apparatus according to the embodiment of the present disclosure.

FIG. 9 is a flowchart of the developer life predicting mode to be executed by the image forming apparatus according to the embodiment of the present disclosure. The mode control unit 984 starts the developer life predicting mode (step S21 in FIG. 9), and executes steps similar to steps S02 to S08 in FIG. 6 (steps S22 to S28 in FIG. 9). If a relation of n=N is satisfied in step S28 (YES in step S28), the mode control unit 984 executes steps similar to steps S10 and S11 in FIG. 6 (step S29 and S30 in FIG. 9). The mode control unit 984 estimates a developer life, described in detail later, (step S31), and ends the developer life predicting mode (step S32).

On the other hand, if a relation of n<N is satisfied in step S28 (NO in step S28), the mode control unit 984 suspends the developer life predicting mode (step S33). The mode control unit 984 then permits the normal image forming operation in the image forming apparatus 10 (step S34). At this time, the mode control unit 984 starts to count the number of sheets to be printed Pt for the image forming operation to be executed by the image forming apparatus 10.

If the number of sheets to be printed Pt exceeds a preset threshold α relating to the number of sheets to be printed to be set in advance (YES in step S35), the mode control unit 984 counts up n by 1 (n=n+1) (step S36) similarly in step S09 of FIG. 6, and repeats steps S23 to S28. If a relation of Pt<α is satisfied in step S35 (NO in step S35), the process returns to step S34 and continues the image forming operation.

The mode control unit 984 executes such a control flow, and thus acquires a plurality of data for obtaining tils of measurement straight line (the image density of the measurement toner image with respective frequencies, FIG. 4) in step S29 with at least the number of sheets to be printed a being provided between the plurality of data. The toner charging amount acquired in step S30 is, thus, greatly affected by deterioration of carrier as described above.

<Developer Life Predicting Method>

Figure 10:
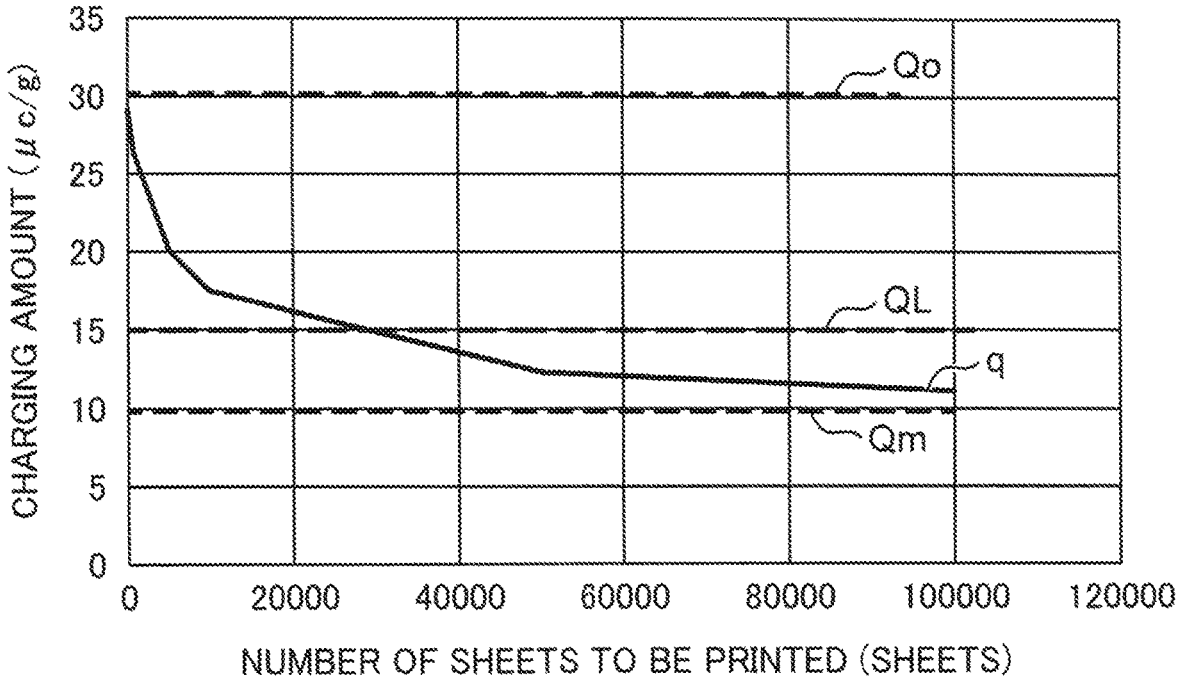
FIG. 10 is a graph for predicting a developer life based on the toner charging amount.

A method for estimating a carrier (developer) life in step S31 of FIG. 9 will be described below. FIG. 10 is a graph for predicting the carrier life based on the toner charging amount acquired in step S30. It is assumed that deterioration of carrier in the developing device 23 changes a long-term toner charging amount as indicated by a line q in FIG. 10.

In this case, a charging amount q can be modeled by expression 3.

$$q=Qm-(Qm-Qo)\exp(-t^{0.5}/\tau) \quad \text{(expression 3)}$$

In the expression 3, a toner saturation charging amount Qm is a known charging amount achieved by toner included in the developer after endurance. An initial toner charging amount is indicated by Qo. The initial toner charging amount Qo can be derived by executing the charging amount measuring mode when the image forming apparatus 10 is installed. Table 1 shows a toner charging amount (a calculated charging amount) derived in the developer life predicting mode according to the present embodiment and a toner charging amount (a measured charging amount) which is actually measured with both the toner charging amounts being associated with the number of sheets to be printed. The toner charging amount was measured by using a suction-type small-sized charging amount measuring device MODEL212HS manufactured by Trek, Inc. Each number of sheets to be printed in Table 1 represents a predicted developer life (a number of sheets) derived by a procedure, described later.

TABLE 1

| NUMBER OF SHEETS TO BE PRINTED t (SHEETS) | MEASURED CHARGING AMOUNT (μc/g) | CALCULATED CHARGNG AMOUNT (μc/g) | METHOD OF LEAST SQUARES τ | PREDICTED LIFE (SHEETS) |
|---|---|---|---|---|
| 0 | 30 | 30 | | |
| 1 | 29.5 | 29.5 | 39.4 | 2989 |
| 5 | 29.6 | 29.5 | 88.8 | 15153 |
| 10 | 29.2 | 29.2 | 79.0 | 12004 |
| 50 | 28.8 | 28.7 | 103.2 | 19564 |
| 100 | 28.1 | 28.1 | 100.9 | 19564 |
| 500 | 26.6 | 26.4 | 114.1 | 25033 |

When the number of sheets to be printed t is plotted along a horizontal axis in the graph of FIG. 10 and a toner charging amount in the case where t=1 is 29.5 μc/g as described in Table 1, 1 is assigned in t in the expression 3, and a value r is obtained such that a difference between the charging amount q and a measured charging amount in Table 1 is smallest in a method of least squares. When a relation of t=1 is satisfied. τ is equal to 39.4 according to the method of least squares. If a relation of t=0 is satisfied, the measured charging amount is equal to the calculated charging amount, and thus the above-described calculation is unnecessary.

A number of sheets to be printed is obtained such that the toner charging amount is a lower limit charging amount (QL=15 μc/g) of the developer to be used. The lower limit charging amount QL is a lower limit of a toner charging amount preset for acquiring a constant image. The derived value r (=39.4 μc/g) is assigned to the expression 3, and a number of sheets t to be printed is calculated to satisfy a relation of q=QL. Herein, as described in Table 1, a carrier predicted life is equal to 2989 sheets in the calculation. This number of sheets to be printed is equal to a number of sheets to be printed which is predicted to reach the lower limit charging amount QL, that is, a developer life.

When the number of sheets to be printed is 100 with reference to Table 1, five charging amount data exist, and the value T is calculated by the method of least squares using the five data. That is, the value T is calculated by the method of least squares such that a difference between the calculated result and the measured result of the charging amount in the five data is smallest. The value r is calculated as 100.9. The obtained value r is assigned to the expression 3, and the number of sheets to be printed for the lower limit charging amount (QL=15 μc/g) is obtained. Herein, the number of sheets to be printed is calculated as 19564. In such a manner, if the toner saturation charging amount Qm and the lower limit charging amount QL are given in advance, the value T is derived from the expression 3, and then the number of sheets to be printed (the developer life) can be obtained such that the toner charging amount is the lower limit charging amount QL. As is clear from Table 1, although the predicted life (the number of sheets) is small at first, when the charging amount data increases with endurance, the predicted life gradually increases and then becomes stable.

In the above description, the value t in the expression 3 is the number of sheets to be printed, but the value t may be a driving time period of the developing device 23, or a total toner consumption in the developing device 23. The value q in the expression 3 may be obtained in a manner that a relation of the toner density×the toner charging amount is satisfied taking the toner density into consideration.

A method of predicting the developer life in step S31 of FIG. 9 includes a method of using the value q to which toner density correction is added. Specifically, it is publicly known that a relation of M/Q=J×Tc+K is satisfied between the toner charging amount Q/M and the toner density Tc, and thus this expression can be used. Symbols J and K represent predetermined constants. In a case where the toner density correction is added, a following procedure is taken.

Data of the toner density in the developing device 23 is acquired from a toner density sensor, unillustrated, mounted to the developing device 23. Data of the toner charging amount is acquired from the result in the charging amount measuring mode. Constants J and K in the above expression are calculated based on these data, and the expression that a relation of M/Q=J×Tc+K is satisfied is completed. It is desirable that this expression is updated every time when the toner density and the toner charging amount are measured. A toner charging amount at a preset reference toner density Tc is calculated based on the constants J and K at an endurance check point (each number of sheets to be printed in Table 1). The calculated charging amount corresponds to the toner charging amount to which the toner density correction is added. A developer life may be predicted in the similar procedure as above with corrected charging amount being regarded as the charging amount q on a vertical axis of FIG. 10.

As for exp (−t0.5/τ) in the expression 3, conventionally, in a case where a sphere rolls along a plane, a change in a surface area, which does not touch the plane, of the sphere is theoretically expressed by exp (−t/τ). The disclosers, however, have gained an insight that exp (−t0.5/τ) represents a more realistic change in the toner charging amount than exp (−t/τ) from various experimental results, and thus the expression of exp (−t0.5/τ) is used. The above-described theoretical exp (−t/τ) may be used.

In the present embodiment, the mode control unit 984 can execute the developer life predicting mode that includes the first measurement toner image forming operation and the developer deterioration information acquisition operation. In this mode, the toner charging amounts in the developing devices 23 can be acquired without using the surface potential sensor that measures potentials on the photoconductive drum 20 and an ammeter that measures developing currents flowing into the developing rollers 231. Therefore, the image forming apparatus 10, which can accurately predict a toner charging amount and can predict a developer deteriorated state based on the charging amount, is provided.

In the present embodiment, the mode control unit 984, in the first measurement toner image forming operation, sets the frequency to a first frequency at a first timing at which the image forming operation is not performed so as to form the measurement toner image, and sets the frequency to a second frequency different from the first frequency at a second timing after at least the image forming operation is performed after the first timing so as to form the measurement toner image.

In such a configuration, measurement toner images are formed at the plurality of timings for different frequencies, and thus a mode required time period at each timing can be shortened.

In the present embodiment, the mode control unit 984 forms measurement toner images for three or more different frequencies, respectively, in the first measurement toner image forming operation.

In such a configuration, density detected results of the measurement toner images can be acquired for three or more frequencies, respectively, and thus tilts of measurement straight lines can be accurately acquired.

When the developer life predicting mode illustrated in FIG. 9 is repeated at every predetermined period, data can be adopted efficiently in a following procedure. That is, it is desirable that the storage unit 983 can store a result of detecting density of the measurement toner image in the density sensor 100, and every time when density detected result of the measurement toner image is acquired for a predetermined frequency, the mode control unit 984 updates the density detected result with the predetermined frequency stored in the storage unit 983, and acquires a tilt of the measurement straight line based on the updated density detected result.

In such a configuration, a tilt of a measurement straight line can be accurately acquired based on new information without using old information relating to the relationship between a frequency and a density detected result.

The developer life information acquired in the developer life predicting mode may be transmitted to a service center through telephone line or internet connection. In this case, a developer life in each place where the image forming apparatus 10 is used can be predicted early, and a timing at which maintenance staff visits each place can be appropriately determined.

<Adjustment of Toner Charging Amount>

Figure 11:
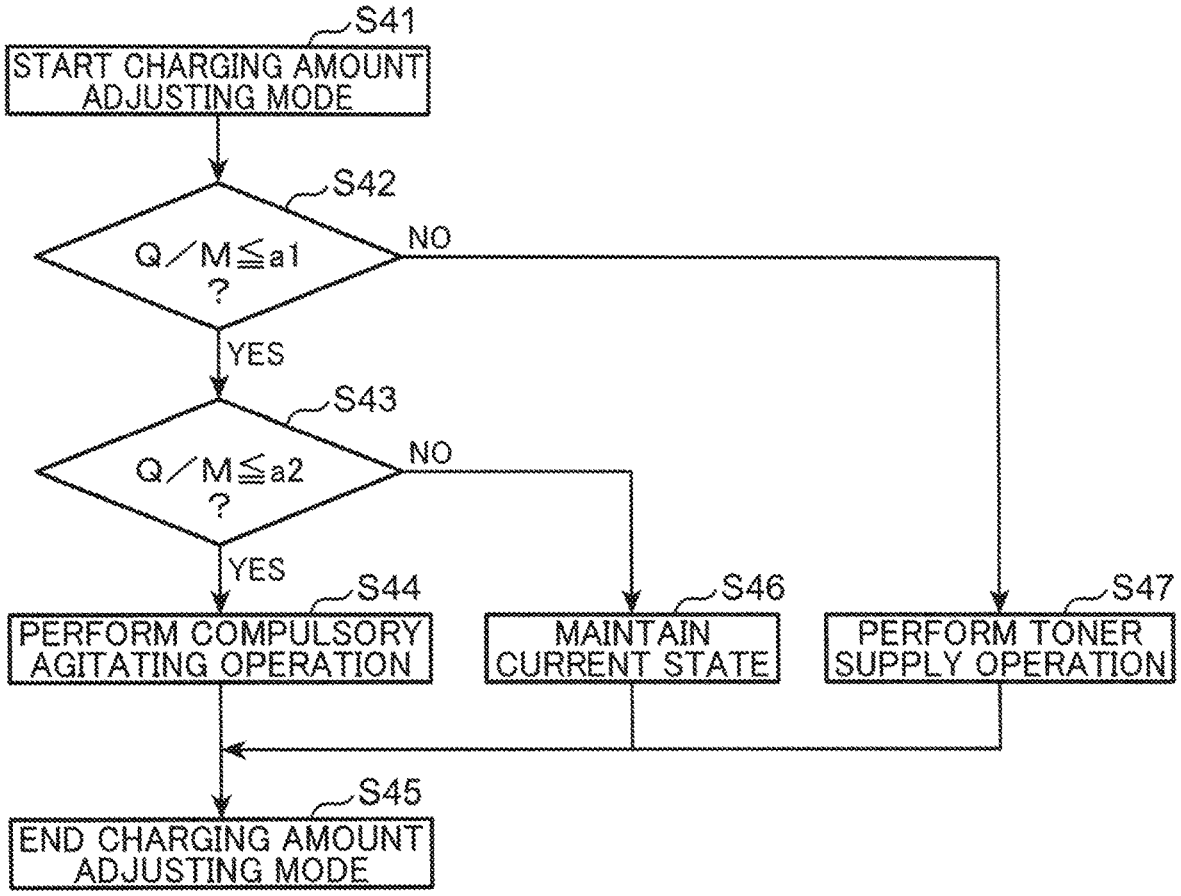
FIG. 11 is a flowchart illustrating a charging amount adjusting mode to be executed in the image forming apparatus according to the embodiment of the present disclosure.

FIG. 11 is a flowchart illustrating a charging amount adjusting mode to be executed in the image forming apparatus 10 according to the present embodiment. The mode control unit 984 (charging amount adjusting unit) can adjust the toner charging amount in the developing device 23 based on the toner charging amount acquired in the charging amount measuring mode or the developer life predicting mode. That is, when the acquired toner charging amount is larger than a preset predetermined threshold (a predetermined range), the mode control unit 984 performs a charging amount decreasing operation for decreasing the toner charging amount, and when the acquired toner charging amount is smaller than the predetermined threshold, the mode control unit 984 performs a charging amount increasing operation for increasing the toner charging amount. Necessity or unnecessity of executing the charging amount adjusting mode may be input by maintenance staff or a user through an operation unit 10P (FIG. 1) of the image forming apparatus 10.

With reference to FIG. 11, when the charging amount adjusting mode is executed (step S41), the mode control unit 984 determines whether the toner charging amount QIM (or q) acquired in the charging amount measuring mode or the developer life predicting mode is a preset threshold a1 or less (step S42). If a relation of Q/M≤a1 is satisfied (YES in step S42), the mode control unit 984 further determines whether the toner charging amount QIM is a preset threshold a2 or less (step S43). The thresholds a1 and a2 are preset to satisfy a relation of a2≤a1, and are stored in the storage unit 983.

If a relation of Q/M≤a2 is satisfied in step S43 (YES in step S43), the mode control unit 984 determines that the toner charging amount in the developing device 23 is small, and executes a compulsory agitating operation (the charging amount increasing operation) (step S44). At this time, the mode control unit 984 rotates the first screw feeder 232 and the second screw feeder 233 in the developing device 23 so as to compulsorily agitate the developer in the development housing 230. This can stably increase the toner charging amount in the developing device 23, and thus a satisfactory image can be formed in in the image forming apparatus 10. After step S44, the mode control unit 984 ends the charging amount adjusting mode (step S45). The mode control unit 984 again executes steps S42 and 43 after step S44, and may check if the toner charging amount returns to an appropriate range.

On the other hand, if a relation of Q/M>a2 is satisfied in step S43 (NO in step S43), the mode control unit 984 determines that the toner charging amount in the developing device 23 is within the appropriate range, and ends the charging amount adjusting mode (step S45) with a current state being maintained (step S46).

If a relation of Q/M>a1 is satisfied in step S42 (NO in step S42), the mode control unit 984 determines that the toner charging amount is large and executes a toner supply operation, for supplying toner from the toner supply unit 15 to the developing device 23, as the charging amount decreasing operation (step S47). As a result, the toner amount in the developing device 23 increases, and thus each toner charging amount can be stably decreased. Therefore, a satisfactory image can be formed in the image forming apparatus 10. After step S47, the mode control unit 984 ends the charging amount adjusting mode (step S45). After step S47, the mode control unit 984 may again execute steps S42 and 43, and check if the toner charging amount returns to the appropriate range.

The execution of the charging amount adjusting mode enables accurate adjustment of the toner charging amount in accordance with the acquired toner charging amount. In this configuration, new toner is supplied to the developing device 23, and thus the toner charging amount in the developing device 23 can be stably decreased.

Examples

The embodiment of the present disclosure will be further described in detail below by giving examples, but the present disclosure is not limited only to the following examples. Experimental conditions in conducted comparative experiments are described below.

<Common Experimental Conditions>

Printing speed: 55 sheets/minute

The photoconductive drum 20: amorphous silicon photoconductor (α-Si)

The developing roller 231: outer diameter; 20 mm, surface shape: knurled grooving, 80 rows of recessed portions (grooves) are formed along the circumferential direction.

The regulating blade 234: made of SUS430, magnetic property, thickness: 1.5 mm Developer conveyance amount after the regulating blade 234: 250 g/m$^2$ Circumferential velocity of the developing roller 231 with respect to the photoconductive drum 20: 1.8 (a trailing direction in an opposing position)

The distance between the photoconductive drum 20 and the developing roller 231: 0.30 mm White portion (background portion) potential VO on the photoconductive drum 20: +270 V Image portion potential VL on the photoconductive drum 20: +20 V The development bias of the developing roller 231: an alternating current voltage square wave in which frequency=6.0 kHz, Duty=50%, and Vpp=1000 V. Vdc (the direct current voltage)=200 V Toner: positively charged toner, volume average particle size: 6.8 μm, toner density; 8%

Carrier: volume average particle size: 35 μm, ferrite resin coated carrier

<Experiment 1>

Under the above conditions, the toner charging amount was adjusted by changing an amount of toner external additive, and the printing operation was performed. Results of the experiment 1 are illustrated in FIGS. 4 and 5. In FIG. 4, the image density of the toner image on the intermediate transfer belt 141 was measured by the density sensor 100, and the toner image density is represented as I.D of a toner fixed image by using a correlation curve indicating a correlation between image density (a sensor output), which was acquired in advance, of the toner image and the image density of the toner fixed image formed on a printing sheet (paper).

FIG. 5 illustrates a relationship between the toner charging amounts and the tilts of the straight lines (the approximation straight lines) in FIG. 4. Expression 4 (described below) of the approximation straight line illustrated in FIG. 5 is stored in the storage unit 983 in advance. Use of this expression 4 enables prediction of the toner charging amount.

In the expression 4, a relation of the tilt=Δ image density/Δ frequency is satisfied (see the tilts in the graph of FIG. 4). [Expression 4]

<Developer>

It was confirmed that pulverized toner and core-shell toner produced a similar effect. It was confirmed that a similar effect was produced at the toner density ranging from 3% to 12%. Toner transfer is caused by an alternating electric field notably when a finer magnetic brush is used. Thus, the volume average particle size of the carrier is preferably 45 μm or less, and more preferably 30 μm or more to 40 μm or less. Resin carrier is more preferable because its true specific gravity is smaller than that of ferrite carrier.

<Carrier>

The carrier was formed by coating a ferrite core having volume average particle size of 35 μm with silicon or fluorine, specifically in the following procedure. 20 parts by mass of silicon resin KR-271 (Shin-Etsu Chemical Co., Ltd.) was dissolved in 200 parts by mass of toluene, and thus an application liquid was prepared for 1000 parts by weight of carrier core EF-35 (made by Powdertech Co., Ltd.). After a fluid bed coating applicator sprayed the application liquid to the carrier core EF-35, and the carrier core EF-35 coated with the application liquid was heated at 200° C. for 60 minutes so that carrier was obtained. In this application liquid, a conductive agent and a charge control agent were mixed within a range between 0 to 20 parts by mass with respect to 100 parts by mass of coating resin and were dispersed. In such a manner, resistance and charging were adjusted.

The embodiment of the present disclosure has been described as above, but the present disclosure is not limited to the embodiment and thus includes following modifications.

(1) In the above embodiment, the aspect in which the surface of the developing roller 231 is subject to the knurled grooving has been described, but the surface of the developing roller 231 may have a dimple shape or may be subject to blast working.

(2) In the above embodiment, the aspect in which the mode control unit 984 can execute both the charging amount measuring mode and the charging amount distribution measuring mode has been described, but the mode control unit 984 may execute any one of the measuring modes.

(3) As illustrated in FIG. 1, in the case where the image forming apparatus 10 includes the plurality of developing devices 23, one or two developing devices 23 execute both or one of the charging amount measuring mode and the charging amount distribution measuring mode according to the embodiment, and another developing device 23 may use the results in the modes.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus that performs an image forming operation for forming an image on a sheet, the image forming apparatus comprising:

an image carrier that is rotated and carries a toner image obtained by developing an electrostatic latent image which is formed on a surface of the image carrier;

a charging device that charges the image carrier to a predetermined charging potential;

an exposing device that exposes the surface of the image carrier charged to the charging potential, based on predetermined image information so as to form the electrostatic latent image, the exposing device being disposed in a rotational direction of the image carrier downstream with respect to the charging device;

a developing device that includes a developing roller that is rotated, carries developer including toner and carrier on a peripheral surface of the developing roller, and supplies the toner to the image carrier so as to form the toner image, the developing device being disposed in a predetermined development nip portion in the rotational direction downstream with respect to the exposing device so as to oppose the image carrier;

a transfer unit that transfers the toner image carried on the image carrier to a sheet;

a development bias applying unit that applies a development bias obtained by superimposing an alternating current voltage on a direct current voltage to the developing roller;

a density detecting unit that detects density of the toner image;

a storage unit that stores reference information in advance for each toner charging amount, the reference information relating to a tilt of a reference straight line representing a relationship between a change amount of a frequency of the alternating current voltage of the development bias and a density change amount of the toner image in a case where the frequency is changed with a potential difference in the direct current voltage between the developing roller and the image carrier being kept constant; and a developer information acquisition unit, wherein the developer information acquisition unit performs a first measurement toner image forming operation for controlling the development bias applying unit at a plurality of timings among which at least the image forming operation is performed so that a potential difference in a direct current voltage between the developing roller and the image carrier is kept constant and a frequency of an alternating current voltage of the development bias is varied among the plurality of timings, and forming a first measurement toner image on the image carrier at the plurality of timings, and a developer deterioration information acquisition operation for acquiring a tilt of a measurement straight line representing a relationship between the change amount of the frequency and a density change amount of the first measurement toner image in the first measurement toner image forming operation based on the change amount of the frequency in the first measurement toner image forming operation and a result of detecting density of the first measurement toner image in the density detecting unit, and acquiring the toner charging amount based on the acquired tilt of the measurement straight line and the reference information in the storage unit so as to acquire information relating to deterioration of the developer based on the acquired toner charging amount, the developer information acquisition unit further performs:

a second measurement toner image forming operation for continuously forming a second measurement toner image on the image carrier at a predetermined timing at which the image forming operation is not performed while changing the frequency of the alternating current voltage of the development bias with the potential difference in the direct current voltage between the developing roller and the image carrier being kept constant, and a toner charging amount acquisition operation for acquiring a tilt of a measurement straight line representing a relationship between the change amount of the frequency and a density change amount of the second measurement toner image in the second measurement toner image forming operation based on the change amount of the frequency in the second measurement toner image forming operation and the result of detecting density of the second measurement toner image in the density detecting unit, and acquiring a charging amount of toner included in the second measurement toner image formed on the image carrier at the predetermined timing based on the acquired tilt of the measurement straight line and the reference information in the storage unit.

2. The image forming apparatus according to claim 1, wherein in the first measurement toner image forming operation, the developer information acquisition unit sets the frequency to a first frequency at a first timing at which the image forming operation is not performed so as to form the first measurement toner image, and, in the second measurement toner image forming operation, the developer information acquisition unit sets the frequency to a second frequency different from the first frequency at a second timing after at least the image forming operation is performed after the first timing so as to form the second measurement toner image.

3. The image forming apparatus according to claim 2, wherein the storage unit stores a result of detecting density of the first and second measurement toner images in the density detecting unit, and every time when a density detected result of the first and second measurement toner images for a predetermined frequency is acquired, the developer information acquisition unit updates the density detected result, which is stored in the storage unit, with the predetermined frequency, and acquires the tilt of the measurement straight line based on the updated density detected result.

4. The image forming apparatus according to claim 1, wherein the developer information acquisition unit forms the first measurement toner image for three or more different frequencies in the first measurement toner image forming operation.

5. The image forming apparatus according to claim 1, further comprising:

a charging amount adjusting unit that adjusts the toner charging amount in the developing device;

wherein when the acquired toner charging amount is larger than a predetermined threshold, the charging amount adjusting unit performs a charging amount decreasing operation for decreasing the toner charging amount, and when the acquired toner charging amount is smaller than the predetermined threshold, the charging amount adjusting unit performs a charging amount increasing operation for increasing the toner charging amount.

6. The image forming apparatus according to claim 5, further comprising:

a toner housing unit for housing toner supplied to the developing device;

wherein the charging amount adjusting unit supplies the toner from the toner housing unit to the developing device in the charging amount decreasing operation.

7. The image forming apparatus according to claim 5, wherein the developing device includes:

a development housing that rotatably supports the developing roller and houses the developer inside; and an agitating member that is rotatably supported to the development housing and agitates the developer, and the charging amount adjusting unit rotates the agitating member in the charging amount increasing operation so as to compulsorily agitate the developer in the development housing.

8. The image forming apparatus according to claim 1, wherein the reference information stored in the storage unit is set such that when the toner charging amount is a first charging amount, the tilt of the reference straight line is negative, when the toner charging amount is a second charging amount smaller than the first charging amount, the tilt of the reference straight line is positive, and as the toner charging amount becomes smaller, the tilt of the reference straight line is greater.

* * * * *